US006310559B1

(12) United States Patent
Laborde et al.

(10) Patent No.: US 6,310,559 B1
(45) Date of Patent: Oct. 30, 2001

(54) MONITORING PERFORMANCE OF DOWNHOLE EQUIPMENT

(75) Inventors: Guy Vachon Laborde, Austin; Anthony F. Veneruso; Gerald W. Robertson, both of Missouri City, all of TX (US); Stephane Hiron, Igny; Bernard G. Juchereau, Voisins-le-Bretonneux, both of (FR)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/195,011

(22) Filed: Nov. 18, 1998

(51) Int. Cl.[7] ..... G06F 19/00

(52) U.S. Cl. ..... 340/853.2; 166/370; 166/372; 702/6; 702/9

(58) Field of Search ..... 340/853.2, 853.3; 166/372, 53, 64, 263, 370; 700/282; 370/242, 244; 702/184, 6, 9

(56) References Cited

U.S. PATENT DOCUMENTS

| | | | | |
|---|---|---|---|---|
| 4,142,148 | * | 2/1979 | Johansson | 324/140 R |
| 4,633,954 | * | 1/1987 | Dixon et al. | 166/372 |
| 4,695,957 | | 9/1987 | Peltier | 702/9 |
| 4,969,130 | * | 11/1990 | Wason | 367/73 |
| 5,123,017 | * | 6/1992 | Simpkins | 371/15.1 |
| 5,132,904 | * | 7/1992 | Lamp | 166/53 |
| 5,210,704 | * | 5/1993 | Husseiny | 364/551.01 |
| 5,253,184 | * | 10/1993 | Kleinschnitz | 371/29.1 |
| 5,331,579 | * | 7/1994 | Maguire | 703/2 |
| 5,862,513 | * | 1/1999 | Mezzatesta | 702/9 |
| 5,927,854 | * | 7/1999 | Kroll | 374/102 |
| 5,948,271 | * | 9/1999 | Wardwell | 210/739 |
| 5,966,511 | * | 10/1999 | Temma | 340/853.2 |
| 6,006,171 | * | 12/1999 | Vines | 702/184 |
| 6,012,015 | * | 1/2000 | Tubel | 702/6 |
| 6,046,685 | * | 4/2000 | Tubel | 340/853.2 |
| 6,069,875 | * | 5/2000 | Miller | 370/244 |
| 6,070,125 | * | 5/2000 | Murphy | 702/11 |
| 6,112,817 | * | 9/2000 | Voll | 166/370 |

FOREIGN PATENT DOCUMENTS

| | | |
|---|---|---|
| WO 97/46793 | 12/1997 | (WO) . |
| WO 00/29707 | 5/2000 | (WO) . |

* cited by examiner

*Primary Examiner*—Michael Horabik
*Assistant Examiner*—Albert K. Wong
(74) *Attorney, Agent, or Firm*—Trop, Pruner & Hu P.C.

(57) ABSTRACT

A method for use with equipment located downhole in a subterranean well includes providing a model describing behavior of the equipment and measuring a state of the equipment downhole. An indication is received of the state at a surface of the well, and the model is modified based on the indication. The system includes a communication link, a circuit and a machine. The communication link is adapted to furnish an indication of a state of the equipment to the surface of the well. The circuit is located downhole and is adapted to detect the state and produce the indication. The machine is adapted to provide a model describing behavior of the equipment and modify the model based on the indication.

32 Claims, 8 Drawing Sheets

MONITORING PERFORMANCE OF DOWNHOLE EQUIPMENT

BACKGROUND

The invention relates to monitoring performance of downhole equipment.

In the production of oil and gas, the reliable operation of downhole equipment typically is of paramount importance. For example, one class of downhole equipment is actuator-based equipment that is used to displace downhole parts, such as pads and sleeves. To accomplish this, an actuator of the equipment may use, as examples, an electromechanical arrangement (an arrangement in which a motor actuates a screw drive, for example) or an electrohydraulic arrangement (an arrangement in which an electric motor is driven by a hydraulic pump or jack cylinder). Quite often, the actuator is used in a well process control application in which the consequences of failure may be potentially very expensive, as failure of the actuator may cause lost production, damage to the well, damage to the reservoir or abandonment of the well, as just a few examples.

A valve is one type of downhole equipment that may use an actuator. For example, a sleeve valve 10 (schematically depicted in FIG. 1) may include a linear actuator 9 to control the flow of well fluid from a producing formation into a central passageway of a production tubing 12. To accomplish this, the valve 10 may include a generally cylindrical sleeve 26 that closely circumstances the outside of the tubing 12. In the operation of the valve 10, a motor 14 (of the actuator 9) actuates a ball screw drive 20 (also of the actuator 9) to move the sleeve 26 to selectively restrict the flow of well fluid through radial ports 8 of the tubing 12.

Performance aspects of the linear actuator 9 may change over time, and unfortunately the actuator 9 may eventually fail. Therefore, it is often desirable for an operator at the surface of the well to know how the linear actuator 9 is performing in order to predict when the actuator 9 is going to fail. Without this knowledge, the operator may unexpectedly lose control of the valve 10 and thus, not be able to plan and take remedial actions (final positioning of the valve 10, as an example). As a result, production may be lost due to the unexpected loss of valve control. It may also be advantageous to observe the performance of the valve 10 for purposes of improving future valve designs.

One way to monitor the performance of the linear actuator 9 is to place circuitry (not shown) downhole to monitor selected parameters (of the actuator 9), such as voltages, currents, speeds and positions. When one or more of the monitored parameters fall outside of predefined limits, the downhole circuitry may transmit stimuli (signals on a bus, for example) uphole to indicate this event. A potential difficulty with this arrangement is that mere indication(s) of one or more limits being exceeded may not sufficiently describe the performance of the linear actuator 9 or provide advance warning of future problems. In other arrangements, downhole circuitry (not shown) may sample selected parameters of the linear actuator 9 at a predefined rate (a rate above the Nyquist rate, for example) so that a continual stream of information may be transmitted uphole that indicates different actual performance aspects of the actuator 9 in real time. However, this arrangement may consume a significant amount of the bandwidth that is available for communicating with downhole equipment.

Thus, there is a continuing need for an arrangement to address one or more of the difficulties described above.

SUMMARY

In one embodiment of the invention, a method for use with equipment located downhole in a subterranean well includes providing a model describing behavior of the equipment and measuring a state of the equipment downhole. An indication is received of the state at a surface of the well, and the model is modified based on the indication.

In another embodiment of invention, a system includes equipment located downhole in a subterranean well, a communication link, a circuit and a machine. The communication link is adapted to furnish an indication of a state of the equipment at a surface of the well, and the circuit is located downhole and adapted to detect the state and produce the indication. The machine is adapted to provide a model describing behavior of the equipment and modify the model based on the indication.

Other embodiments of the invention will become apparent from the following description, from the drawing and from the claims.

DETAILED DESCRIPTION

Figure 1:
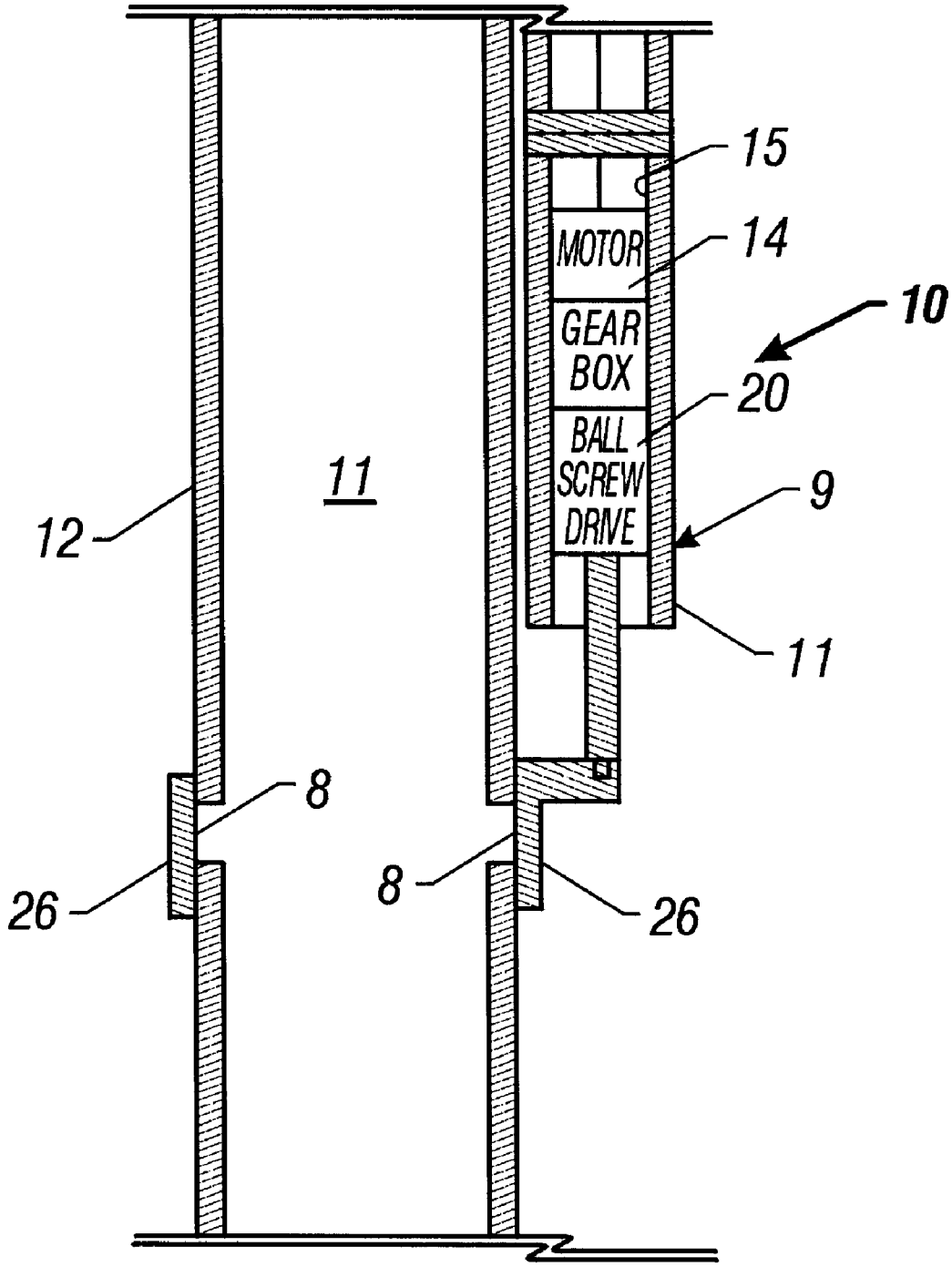
FIG. 1 (Prior Art)
FIG. 1 is a cross-sectional view of a valve of the prior art.
Figure 2:
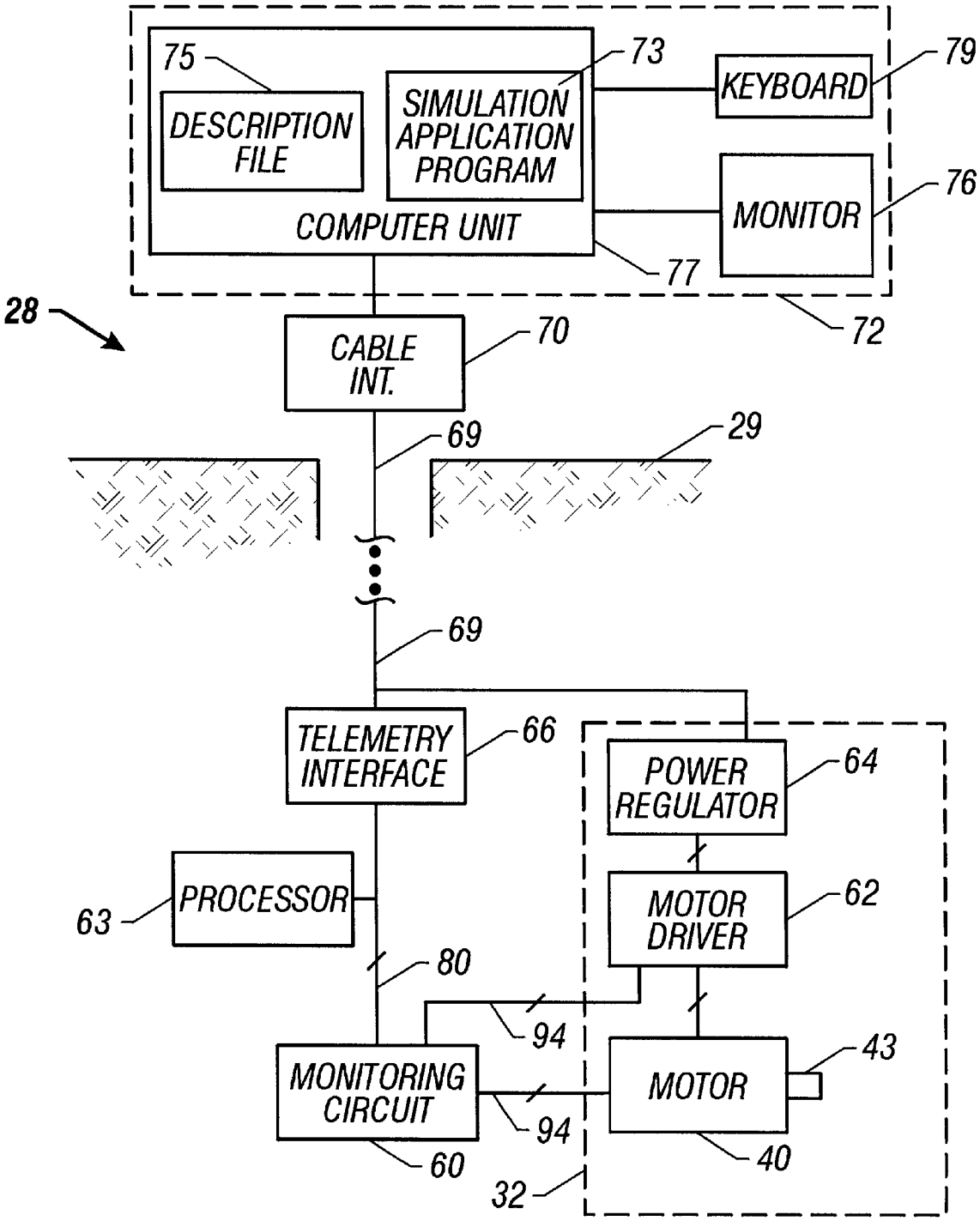
FIG. 2 is a schematic diagram of a system to monitor performance of a downhole actuator according to an embodiment of the invention.

Referring to FIG. 2, an embodiment 28 of a system to monitor performance of downhole equipment (located in a subterranean well) in accordance with the invention may include a downhole monitoring circuit 60 and a machine, such as a computer system 72, that is located at a surface 29 of the well. As an example, the downhole equipment may include a linear actuator 32 (an electrical schematic of the linear actuator 32 is shown in FIG. 2) that forms part of a downhole production valve. For purposes of evaluating performance of the linear actuator 32 (and valve), the computer system 72 may provide a model that describes different performance aspects of the linear actuator 32. In this manner, the computer system 72 may execute a program (a simulation application program 73, for example) to mathematically model the performance of the linear actuator 32 and display waveforms that illustrate different projected real time performance aspects of the actuator 32.

The model may be developed using values obtained from one or more tests of the linear actuator 32 before the linear actuator 32 is installed downhole. Because over time the linear actuator 32 performs differently than when new, the performance aspects provided by the model may differ from the actuator's actual performance. However, as described below, the system 28 uses a feedback scheme to ensure that the performance aspects that are projected by the model are consistent with the observed actual performance of the linear actuator 32. In this manner, the feedback scheme may utilize a downhole monitoring circuit 60 to capture states of the actuator 32.

In contrast to the arrangements found in conventional systems, the monitoring circuit 60 captures a state of the linear actuator 32 by measuring selected characteristics, or parameters, of the actuator 32. After performing the measurements, the monitoring circuit 60 transmits indications of the captured state uphole so that the model may be updated, and this process may be repeated over time to track the actual performance of the actuator 32. As an example, the monitoring circuit 60 may measure the selected parameters while the actuator 32 is in steady state motion, and the parameters may include one or more of the following: an input terminal voltage of a driver 62 (of the motor 40), an input terminal voltage of a power regulator 64, a peak value of a current in the motor 40, a peak value of a voltage of the motor 40, an average value of a current of the motor 40, an average value of a speed of the motor 40 and an average value of a voltage of the motor 40, as just a few examples.

Thus, to summarize, for one feedback iteration, the monitoring circuit 60 captures a snapshot of a state of the actuator 32, and this captured state is used to calibrate the model. The captured state reflects selected parameters that are measured by the monitoring circuit 60. This process may be repeated over time to regularly update the model. As a result of this arrangement, the model provides continuous waveforms that illustrate actual performance aspects of the linear actuator 32 without consuming a significant amount of the bandwidth that is available for uphole communications.

To transmit indications of the measured state uphole, the monitoring circuit 60 may be coupled (via an internal bus 80, for example) to a telemetry interface 66. The telemetry interface 66 is adapted to transmit indications of the parameters uphole via a communication link, such as a cable 69 that includes wires for transmitting indications of the measured parameters uphole using standard telemetry methods. A processor 63 (a microprocessor or a microcontroller, as examples) may coordinate the performance of the measurements by the monitoring circuit 60 and may coordinate the activity of the telemetry interface 66. The processor 63 may be coupled to the bus 80.

At the surface 29 of the well, the computer system 72 may receive (via a cable interface 70) indications of the selected parameters from the cable 69 and use the indications to calibrate the model to reflect the actual performance of the actuator 32. As an example, in some embodiments, the computer system 72 may include a computer unit 77 that stores a description file 75 (on a disk drive, for example) that mathematically describes the operation of the linear actuator 32. In this manner, the computer unit 77 may execute the simulation application 73 that, in turn, uses the description file 75 to mathematically model the actuator 32 so that different projected real time performance aspects of the linear actuator 32 may be displayed on a monitor 76 of the computer system 72. The simulation application 73 may be stored on a disk drive of the computer unit 77, for example. As the indications of the sampled parameters are received from downhole, the description file 75 may be manually updated (via a keyboard 79 of the computer system 72, for example), or in some embodiments, the computer unit 77 may automatically update the description file 75.

In some embodiments, the computer system 72 may not be located near the surface 29 of the well. For example, in some embodiments, the computer system 72 may communicate with circuitry near the well via a network link. Other arrangements are possible.

Electrically, the linear actuator 32 may include the power regulator 64 that receives power that is provided by a DC voltage source (not shown) that is located at the surface 29. The power regulator 64 may furnish a regulated voltage to the motor driver 62 that selectively activates to the motor 40, as directed by the processor 63. The motor 40 may be a brushless DC motor, as an example.

Figure 3:
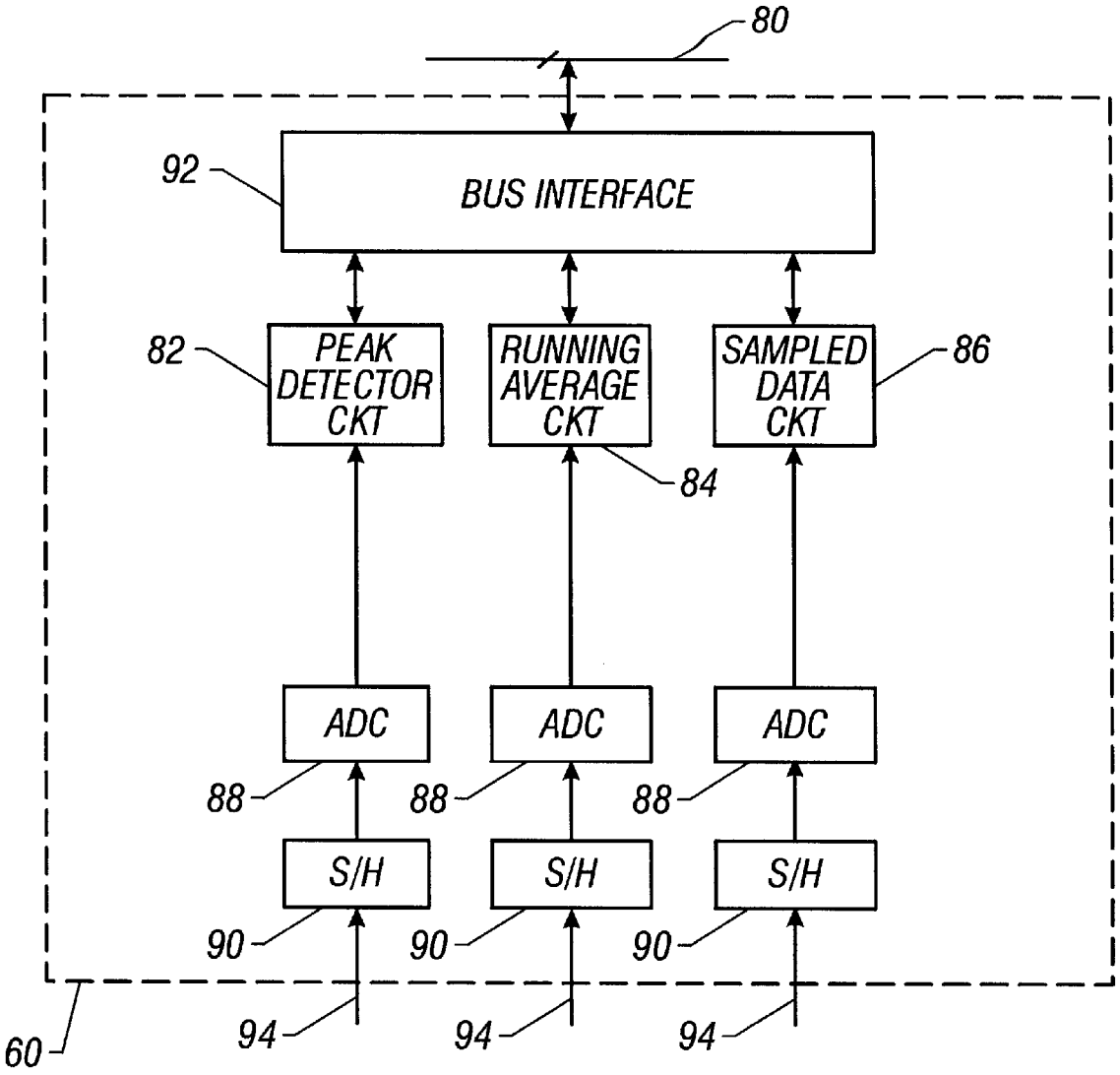
FIG. 3 is a schematic diagram of a monitoring circuit of FIG. 2 according to an embodiment of the invention.

Referring to FIG. 3, in some embodiments, the monitoring circuit 60 may include, as examples, a peak detector circuit 82, a running average circuit 84 and a sampled data circuit 86 (including memory to store sampled values, for example) to measure selected parameters from the motor driver 62 and the motor 40, as examples. The monitoring circuit 60 may receive each monitored voltage and/or current on an associated sensing line 94 that is coupled to an input terminal of an associated sample and hold (S/H) circuit 90. The S/H circuit 90 samples a voltage/current of the associated sensing line 94 and provides the sampled analog value to an associated analog-to-digital converter (ADC) 88 that converts the analog value into a digital value. In this manner, for each voltage/current being measured, the monitoring circuit 60 may receive one of the sensing lines 94 and include one of the S/H circuits 90 and one of the ADCs 88. Thus, each ADC 88 provides a digital value of the voltage/current to one of the peak 82, running average 84 or sampled data 86 circuits, as examples. In some embodiments, the monitoring circuit 60 may include a bus interface 92 for establishing communication between the circuits 82, 84 and 86 and the bus 80.

Figure 4:
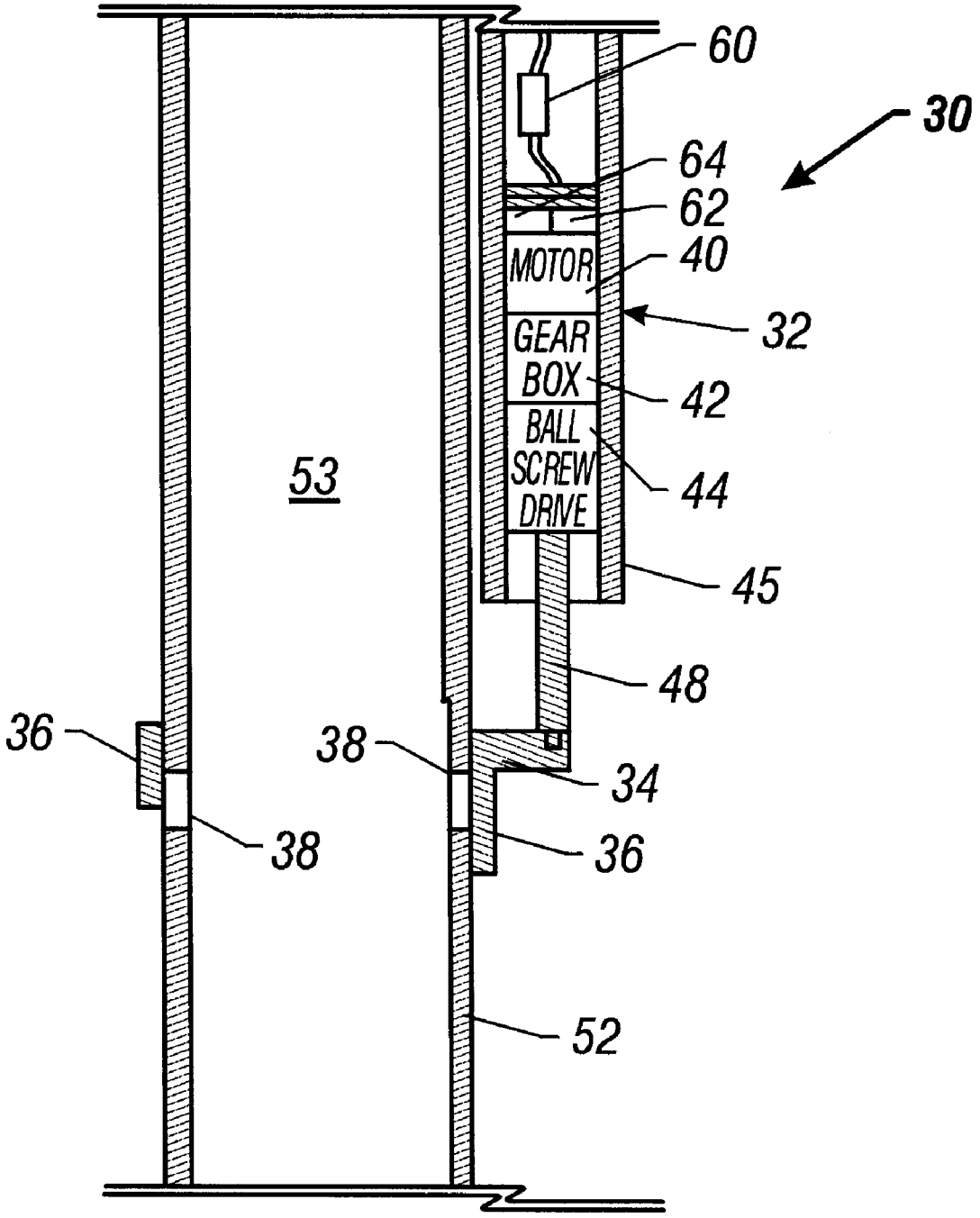
FIG. 4 is a cross-sectional view of a valve according to an embodiment of the invention.

Referring to FIG. 4, as an example, the linear actuator 32 may be part of a valve, such as a sleeve valve 30, that controls the flow of well fluid into a central passageway 53 of a production tubing 52. To accomplish this, the linear actuator 32 may control translational movement of a generally cylindrical sleeve 36 that is coaxial with and closely circumscribes the tubing 52 so that the sleeve 36 may control the flow of well fluid into radial ports 38 of the tubing 52. In some embodiments, to move the sleeve 36, the linear actuator 32 has a shaft 48 that is coupled (via an elbow 34) to the sleeve 36. In this manner, the motor driver 62 (see FIG. 2) may selectively activate (turn on and off, for example) the linear actuator 32 to selectively move the shaft 48 to generally control fluid communication through the ports 38.

To move the shaft 48, the motor 40 may be operatively coupled (via a shaft 43, depicted in FIG. 2) to a gear box 42 to transfer torque to an actuator drive assembly, such as a ball screw drive 44, to move the shaft 48 either in a direction that restricts flow into the radial ports 38 or in a direction that allows more fluid to flow into the radial ports 38. The motor 40, the gear box 42 and the ball screw drive 44 may all be housed inside a generally cylindrical sealed housing 45 that may be mounted to the outside of the production tubing 52.

The performance of downhole equipment other than actuator-based equipment may be monitored using the techniques described above. Furthermore, the performance of other valves, such as a ball valve, for example, or other flow restriction devices may be monitored using the techniques described above.

Figure 5:
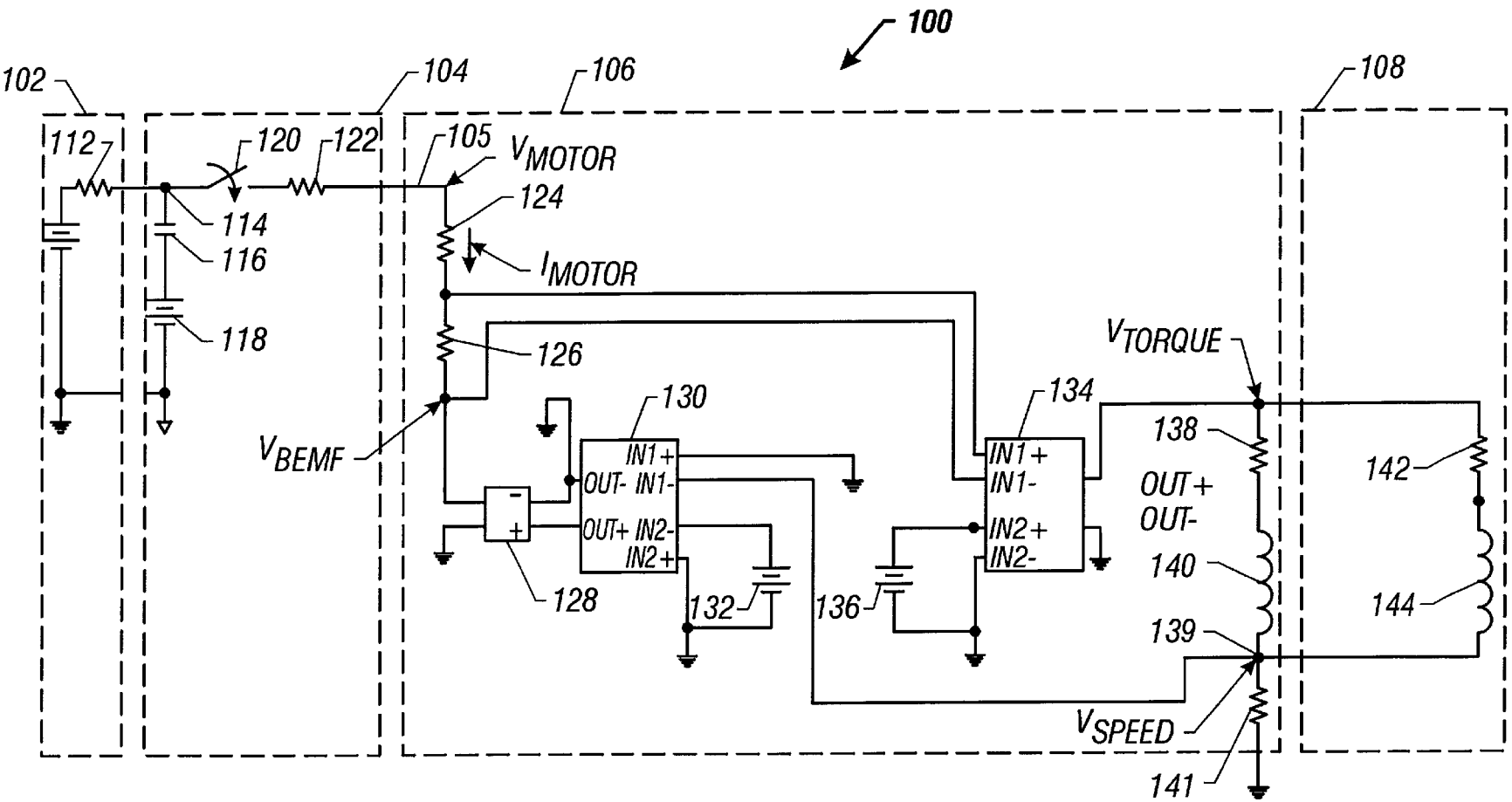
FIG. 5 is a schematic diagram illustrating a model of the system.

Referring to FIG. 5, as an example, the simulation application program 73 may be a Simulation Program with Integrated Circuit Emphasis (SPICE) application program that mathematically models the behavior of an electrical circuit that is described in a text file, such as the description file 75, for example. In this manner, selected aspects of the system 28 may be electrically represented by a circuit schematic 100 that is described by text of the description file 75. More particularly, circuit sections 102, 104, 106 and 108 of the schematic 100 may generally represent a downhole power delivery system; the motor driver 62; the motor 40; and the remaining portion of the valve 30, respectively.

In some embodiments, the circuit section 102 may include a DC voltage source 110 that represents a DC voltage source (not shown) at the surface 29 that supplies power to the cable 69. The cable 69, in turn, includes wires for transferring the power downhole. The impedance of the cable 69 may be represented by a resistor 112 that is serially coupled between the DC voltage source 110 and an input terminal 114 of the circuit section 104 that represents the motor driver 62.

As an example, the circuit section 104 may include a switch 120 that is in series with a resistor 122. The switch 120 selectively provides power to the circuit section 106 (that represents the motor 40) to simulate the on/off switching of the motor 40 by the motor driver 62. The resistor 122 is coupled between the switch 120 and an input terminal 105 of the circuit section 106 and may represent, for example, the output resistance of the motor driver 62. To establish a transient response of the circuit 100, the circuit section 104 may include a DC voltage source 118 for establishing a peak terminal voltage of the motor 40 when the switch 120 is first turned on and a capacitor 116 that is serially coupled between the DC voltage source 118 and the input terminal 114.

In some embodiments, the circuit section 106 may include a resistor 124 that has one terminal coupled to the input terminal 105 and is coupled in series with a resistor 126. The resistor 124 may represent the resistive input impedance of the motor 40, for example, and the resistor 126 may be used to sense the input current of the motor 40 for purposes of modeling a speed and a back electromotive force (EMF) of the motor 40, as described below.

More particularly, the circuit section 106 may include an ideal AC/DC multiplier module 134 that has two sets of input terminals. One set of the input terminals is coupled to receive the voltage across the resistor 126. The other set of input terminals is coupled to a DC potential that is established by a DC voltage source 136. The inverting output terminal of the multiplier module 134 is coupled to ground. Thus, as a result of this arrangement, the non-inverting output terminal of the multiplier module 134 furnishes a summation of a scaled version of the input current of the motor 40 and a constant.

For purposes of representing frictional losses and inertia of the motor 40, the circuit section 106 may include a resistor 138 (representing frictional losses) and an inductor 140 (representing inertia) that are serially coupled together between the non-inverting output terminal of the multiplier module 134 and a feedback node 139. A resistor 141 may be coupled between the feedback node 139 and ground, and the voltage of the feedback node 139 may represent a speed of the motor 40, as described below.

To use the voltage of the node 139 to derive a back EMF voltage of the motor 40, the feedback node 139 is coupled to an inverting input terminal of one of two sets of input terminals of an ideal AC/DC multiplier module 130. The non-inverting input terminal of this set of input terminals is coupled to ground. A DC voltage source 132 may be coupled across another set of input terminals of the multiplier module 130. Due to this arrangement, the voltage across the output terminals of the multiplier module 130 represents the back EMF voltage of the motor 40. An ideal voltage controlled voltage source 128 may couple the output voltage of the multiplier module 130 in series with the resistors 124 and 126 and serve as a buffer to add the back EMF voltage to the input circuit path.

In some embodiments, the frictional losses and the inertia attributable to the gearbox 42 and the remaining portion of the valve 30 are represented by a resistor 142 and an inductor 144 of the circuit portion 108. In this manner, the resistor 142 (representing frictional losses) and the inductor 144 (representing inertia) are serially coupled together between the non-inverting output terminal of the multiplier module 134 and the feedback node 139.

Figure 6:
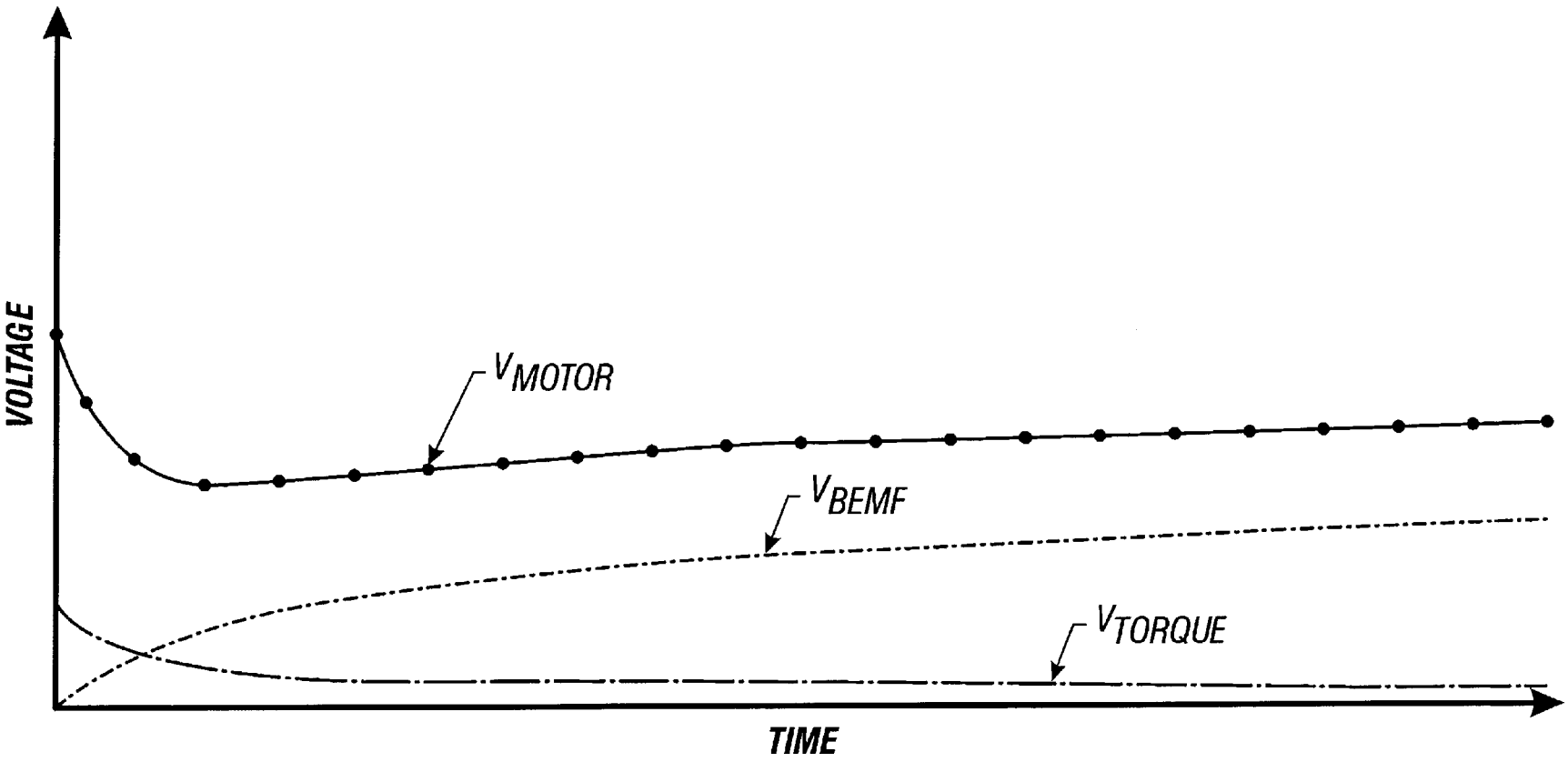
FIGS. 6 and 7 are plots of voltages and currents derived from the behavioral model illustrating a performance of a linear actuator of the system.
Figure 7:
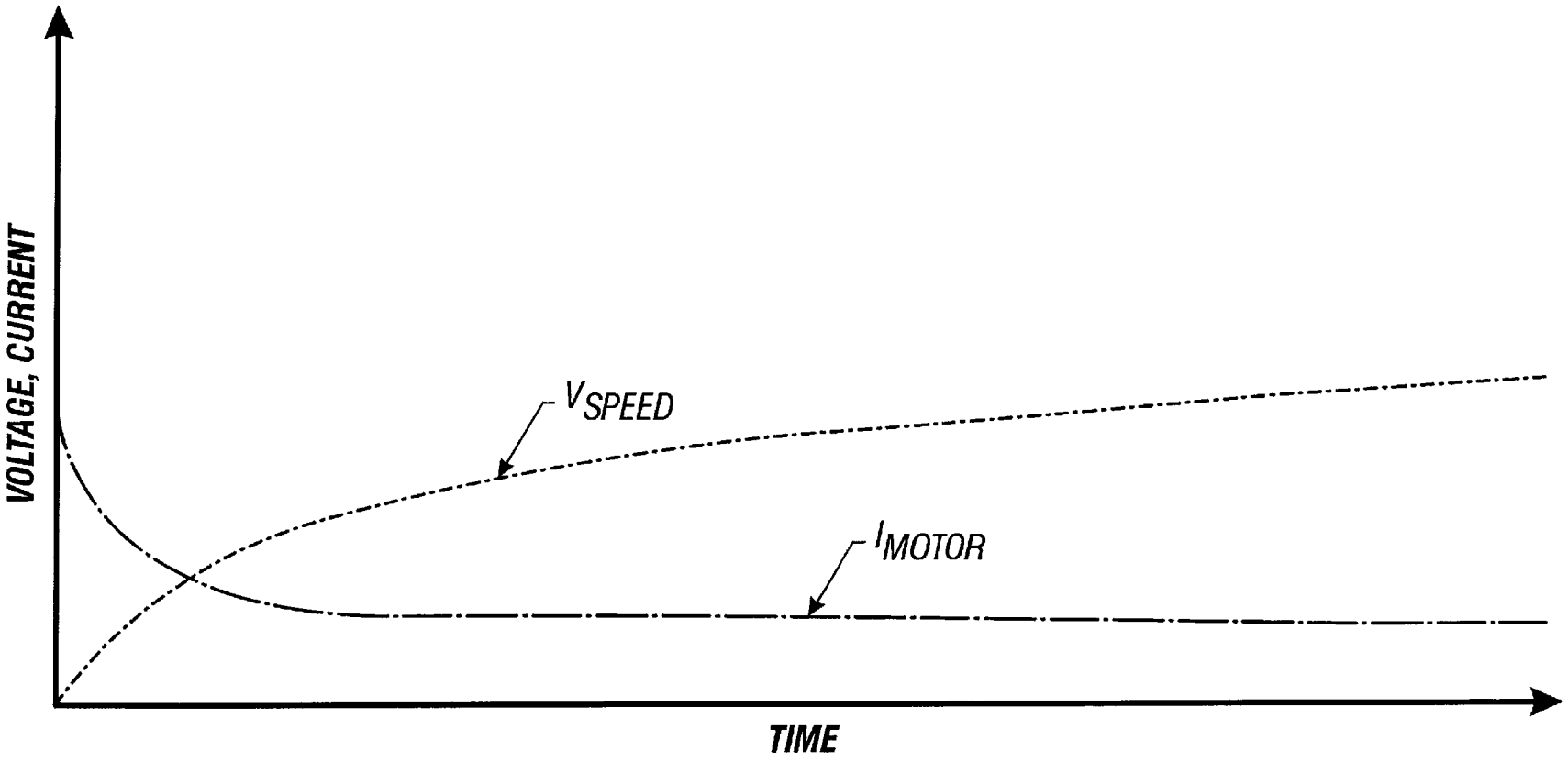

Due to the modeling of the system 28 that is defined by the circuit 100, voltages and currents of the circuit 100 may be viewed, or "probed," to monitor different performance aspects of the actuator 32. For example, the voltages and/or currents may be viewed over an interval of time during which the actuator 32 is in steady state motion, for example. As examples, referring to FIG. 6, when the circuit 100 is simulated, the node 105 furnishes a voltage (called $V_{MOTOR}$) that indicates a terminal voltage of the motor 40, the output terminal of the source 128 furnishes a voltage (called $V_{BEMF}$) that indicates the back EMF of the motor 40, and the non-inverting output terminal of the multiplier module 134 furnishes a voltage (called $V_{TORQUE}$) that indicates a torque of the motor 40. Referring to FIG. 7, as other examples, the node 139 furnishes a voltage (called $V_{SPEED}$) that indicates the speed of the motor 40, and a current (called $I_{MOTOR}$) of the resistor 124 indicates an input current of the motor 40. These waveforms may be analyzed to determine different performance aspects of the system 28 to indicate, for example, when the actuator 32 is going to fail and reveal improvements for future actuator designs. In some embodiments, the computer system 72 may automatically determine when the actuator 32 is going to fail and alert the operator when this occurs. In some embodiments the computer system 72 may automatically take corrective action when potential failure of the actuator 32 is detected, such as shutting off the valve 30, for example.

Figure 8:
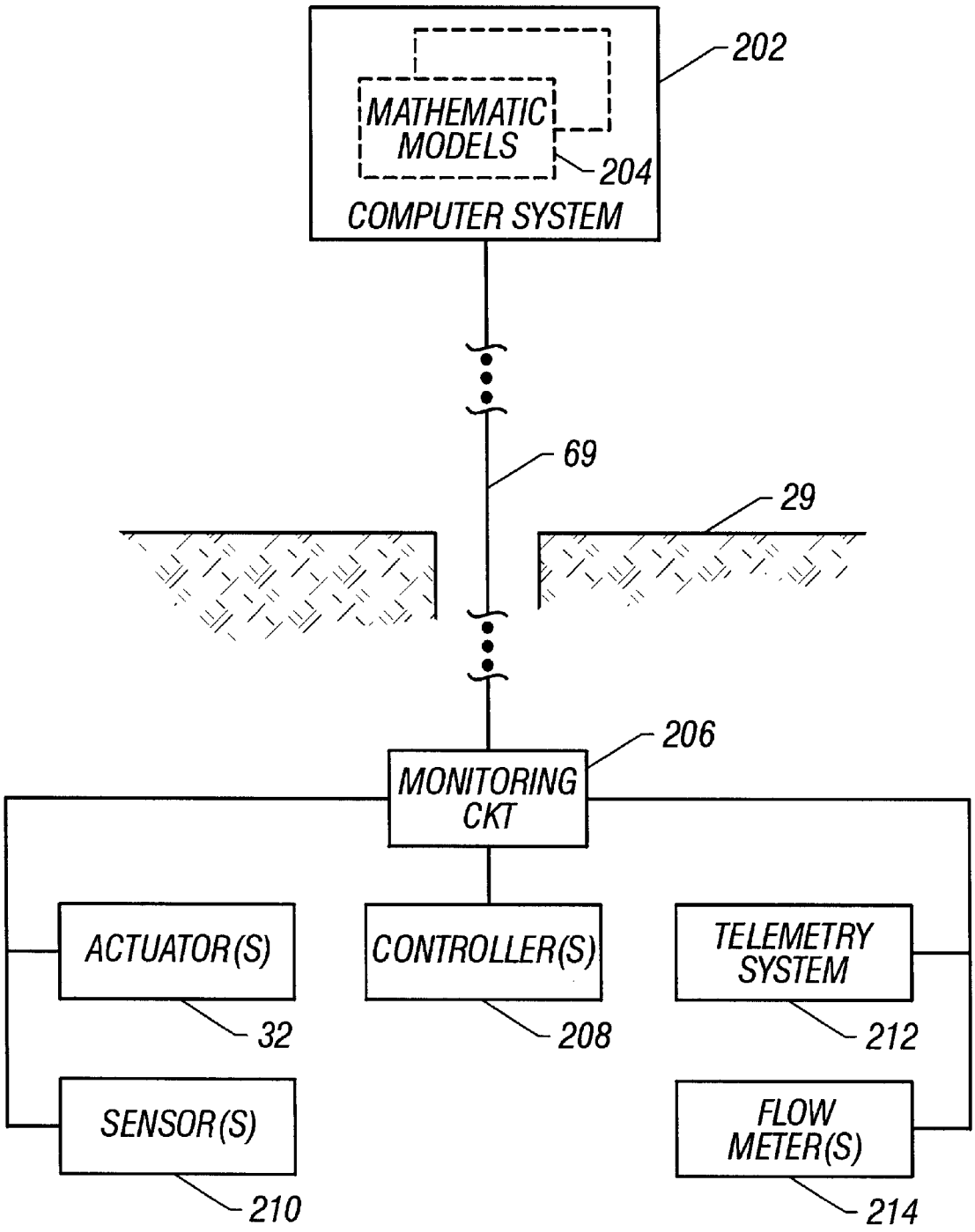
FIG. 8 is a schematic diagram of a system to monitor performances of various pieces of downhole equipment according to an embodiment of the invention.

Other embodiments are within the scope of the following claims. For example, referring to FIG. 8, a computer system 202 may provide mathematical models 204 for downhole equipment other than the linear actuator 32 described above. In this manner, the computer system 202 may mathematically model downhole sensor(s) 210, controller(s) 208, a telemetry system 212 and flow meter(s) 214, as just a few examples. To accomplish this, a downhole monitoring circuit 206 may measure various parameters of these pieces of equipment, and a telemetry interface (not shown in FIG. 8) may transmit indications of these measurements uphole. These indications, in turn, may be used to modify and monitor the models 204.

The computer system 202 may use the models 204 to detect equipment failure. For example, one of the sensors 210 may indicate a formation pressure, and the particular sensor 210 may indicate a rapid change in pressure. However, via the model 204, the computer system 202 may determine a properly functioning sensor cannot measure such a rapid pressure change. As a result, the computer system 202 may automatically alert the operator that the particular sensor 210 has failed, or the computer system 202 may automatically take corrective action, such as switching in a new sensor downhole to replace the failed sensor 210.

As another example, the computer system 202 may obtain bus voltages, among other parameters, from the telemetry system 212. Based on the mathematical model 204 of the telemetry system 212, the computer system 202 may determine that a segment of the telemetry system 212 has failed. The computer system 202 may, for example, automatically reroute communications to bypass the failed segment.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method for use with equipment located downhole in a subterranean well, comprising:

providing a model describing behavior of the equipment;

measuring a state of the equipment downhole;

receiving an indication of the state at a surface of the well; and modifying the model based on the indication.

2. The method of claim 1, further comprising: using the model to observe a performance of the equipment.

3. The method of claim 1, further comprising:

automatically indicating potential failure of the equipment based on a performance projected by the model.

4. The method of claim 1, further comprising:

automatically taking corrective action based on a performance projected by the model.

5. The method of claim 2, wherein the act of using comprises: executing a circuit simulation program.

6. The method of claim 2, wherein the act of using comprises: monitoring a plot of a characteristic of the equipment over time.

7. The method of claim 6, wherein the characteristic comprises a voltage.

8. The method of claim 6, wherein the characteristic comprises a current.

9. The method of claim 1, wherein the state comprises a sampled voltage.

10. The method of claim 1, wherein the state comprises a sampled current.

11. The method of claim 1, wherein the state comprises a sampled peak value.

12. The method of claim 1, wherein the state comprises a sampled average value.

13. The method of claim 1, further comprising:

transmitting a stimuli from downhole near the equipment to produce the indication at the surface.

14. The method of claim 1, wherein the equipment comprises an actuator.

15. The method of claim 1, wherein the equipment comprises a sensor.

16. The method of claim 1, wherein the equipment comprises a controller.

17. The method of claim 1, wherein the equipment comprises a telemetry system.

18. A system comprising:

equipment located downhole in a subterranean well;

a communication link adapted to furnish an indication of a state of the equipment to a surface of the well;

a circuit located downhole and adapted to detect the state and produce the indication; and a machine adapted to:

provide a model describing behavior of the equipment; and modify the model based on the indication.

19. The system of claim 18, wherein the machine is adapted to modify the model based on data input by a user, the data indicating the state.

20. The system of claim 18, wherein the machine is adapted to automatically modify the model based on the indication furnished by the communication link.

21. The system of claim 18, wherein the machine comprises a computer system.

22. The system of claim 18, wherein the machine is located near the surface of the well.

23. The system of claim 18, wherein the equipment comprises an actuator.

24. The system of claim 18, wherein the equipment comprises a sensor.

25. The system of claim 18, wherein the equipment comprises a controller.

26. The system of claim 18, wherein the equipment comprises a telemetry system.

27. The system of claim 18, wherein the machine is further adapted to display a performance of the equipment based on the model.

28. The system of claim 18, wherein the machine is further adapted to display a plot of a characteristic of the equipment based on the model.

29. The system of claim 18, wherein the machine is further adapted to take corrective action based on a performance of the equipment projected by the model.

30. The system of claim 18, wherein the circuit comprises a peak detector.

31. The system of claim 18, wherein the circuit comprises an averaging circuit.

32. The system of claim 18, wherein the circuit comprises a sample and hold circuit.

* * * * *